United States Patent [19]

Scollan, Jr.

[11] Patent Number: 4,744,576

[45] Date of Patent: May 17, 1988

[54] ROLLER BOARD APPARATUS WITH INDEPENDENT LATERALLY COMPLIANT SURFACE AND BRAKING RESISTANCE

[76] Inventor: Hugh J. Scollan, Jr., 18671 Crabtree Avenue, Cupertino, Calif. 95014

[21] Appl. No.: 60,681

[22] Filed: Jun. 11, 1987

[51] Int. Cl.[4] ..... A63C 17/26

[52] U.S. Cl. ..... 280/87.04 A; 280/11.1 BT; 11.2/87.04 R; 272/97

[58] Field of Search ..... 280/87.04 A, 87.04 R, 280/11.2, 11.1 BT; 272/114, 146, 97; D21/226, 227

[56] References Cited

U.S. PATENT DOCUMENTS

| | | | |
|---|---|---|---|
| 2,366,866 | 1/1945 | Moller | 280/87.04 R |
| 2,474,082 | 6/1949 | Wutz | 280/11.19 |
| 2,545,543 | 3/1951 | Bottrill | 280/11.2 |
| 3,023,022 | 2/1962 | Boyden | 280/87.04 A |
| 3,399,904 | 9/1968 | Schinke | 280/87.04 R |
| 3,436,088 | 4/1969 | Kunselman | 280/11.9 |
| 3,684,305 | 8/1972 | McDonald et al. | 280/11.19 |
| 3,856,321 | 12/1974 | Solymosi | 280/87.04 R |
| 3,891,225 | 6/1975 | Sessa | 280/11.19 |
| 4,134,598 | 1/1979 | Urisaka | 280/11.22 |
| 4,134,600 | 1/1979 | McDonald et al. | 280/87.04 A |
| 4,235,448 | 11/1980 | Thomas | 280/87.04 A X |
| 4,353,566 | 10/1982 | Mohlenbrock | 280/87.04 A |

*Primary Examiner*—David M. Mitchell
*Assistant Examiner*—Tamara L. Finlay
*Attorney, Agent, or Firm*—Fliesler, Dubb, Meyer & Lovejoy

[57] ABSTRACT

Roller board apparatus for supporting a rider on payment or the like comprising a foot supporting laterally compliant surface, support at opposite ends with skate-type wheel units. The lateral flexibility of the riding surface (crosswise to the direction of travel) provides the rider with lateral motion by centrifugal force and leg motion which simulates the lateral compliance experienced in snow and water skiing. This laterally flexible surface is spring-biased to a centered neutral position. Turning is initiated by the rider shifting his or her weight on the laterally flexible surface opposite to the direction of the turn. Stability is maintained by exterior wheels on lateral sides of the board upon a flexible structure and additionally provide forward motion resistance through friction thus allowing the rider to control speed on inclined surfaces by turning.

6 Claims, 12 Drawing Sheets

ROLLER BOARD APPARATUS WITH INDEPENDENT LATERALLY COMPLIANT SURFACE AND BRAKING RESISTANCE

BACKGROUND OF THE INVENTION

1. Field of the Invention

The present invention relates in general to recreation equipment and more particularly to a platform equipped with skate-type wheel units with a laterally compliant sliding surface (crosswise to the longitudinal axis of the platform) approximating the lateral compliance experienced in some forms of snow skiing and water skiing.

2. Description of the Prior Art

Proposals have been made heretofore for recreational equipment enabling enjoyment of such sports on dry land surfaces. These proposals in general provide rider supporting structures mounted on rollers for use on inclined surfaces. Dry land skiing apparatus is representative. The closest known prior art heretofore proposed is disclosed in: McDonald U.S. Pat. No. 4,134,600, Schinke U.S. Pat. No. 3,399,904, Boyden U.S. Pat. No. 3,023,022, McDonald U.S. Pat. No. 3,684,305. Each of these prior constructions and others of a more remote construction fail to provide the rider with an independent lateral degree of freedom upon a rigid platform construction.

An independent lateral degree of freedom requires that the extent of lateral motion on a rigid platform fitted with a wheeled steering mechanism be adjustable and independent of the arc of curvature of the steering mechanism in a turn, and that lateral shifting occurs with both of the rider's feet. This is in contrast to the above-identified prior art which do not provide such action. This lateral motion (crosswise to the platform's longitudinal axis) referred to above is analogous to slalom skiing where the skier's speed is limited by lateral slipping relative to the longitudinal axis of the skis as tight turns are negotiated.

An additional feature of this invention is the provision of wheels mounted on each end of a flexible structure extending laterally from the platform. These wheels and the flexible structure to which they are attached provide tilt resistance as the rider shifts his or her weight to an off-center position, controls the arc of curvature obtainable with the steering mechanism (skate type wheel units), and provides rolling resistance by means of a frictional type braking system on the wheels, thus allowing the rider to control speed on inclined surfaces.

McDonald U.S. Pat. No. 4,134,600 discloses external rollers which are used to limit impact of the riding structure with the ground. However, the wheels are not in contact with the ground except in extreme turns and are not meant to be used to limit forward speed. In addition, the roller-biased angular position illustrated in this reference is associated with a turn direction which is opposite to the currently proposed invention.

Schinke U.S. Pat. No. 3,399,904 utilizes lateral positioned rollers as a tilt restraint which are intimately part of the turning mechanism. In contrast, the lateral wheels supported on the flexible structure of the present invention are not used as a turning mechanism, but are used only for support as the rider slides laterally and for braking resistance in turns.

SUMMARY OF THE INVENTION

A principal object of the present invention is a roller board apparatus comprising a platform having a riding surface with a laterally compliant degree of freedom relative to the longitudinal axis of the platform. This is achieved by a platform structure which is curved up towards the lateral edges (curved so that the bases of a rider's feet remain substantially parallel to the surface upon which the apparatus is used).

In an embodiment of the present invention, the platform structure is covered with a low friction material (TFE-"Teflon") upon which a riding pad is elastically spring-biased to the center. The pad slides on the low friction curved platform structure as lateral force is applied.

In practice, the rider on the riding pad slides on the low friction curved platform structure due to centrifugal force in turns. As sliding occurs, tension in spring members attached between the curved board structure and riding pad increases force resistance thus aiding the rider to return to the center of the curved platform structure after completion of the turn.

The steering mechanism comprises skate-type wheel units which are attached to the front and rear ends of the curved platform structure on the centerline thereof. These wheels respond to tilt about the curved platform structure longitudinal axis. The skate-type wheel units are opposed such that off-center loading to the right of the centerline of the curved platform structure results in the skate-type wheel units steering to the left. Off-center loading to the left of the centerline of the curved platform structure results in the skate-type wheel units steering to the right. No known prior art discloses skate-type wheel units which operate in this fashion.

The combination of the lateral degree of freedom and said operation of the skate-type wheel units result in an approximation of the dynamic mechanisms associated with lateral sliding due to centrifugal force in a direction opposite to a turn which is associated with such sports as snow skiing and water skiing. No known prior art designs include such lateral compliance which is independent of a steering mechanism.

BRIEF DESCRIPTION OF DRAWING

The above and other objects, features and advantages of the present invention will become apparent from the following detailed description of the accompanying drawing in which.

DETAILED DESCRIPTION OF THE DRAWING

Figure 1:
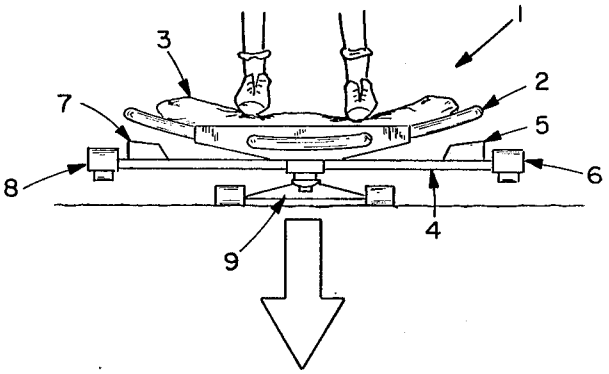
FIG. 1 is a front elevation view of a roller board apparatus according to the present invention moving in a straight line.
Figure 2:
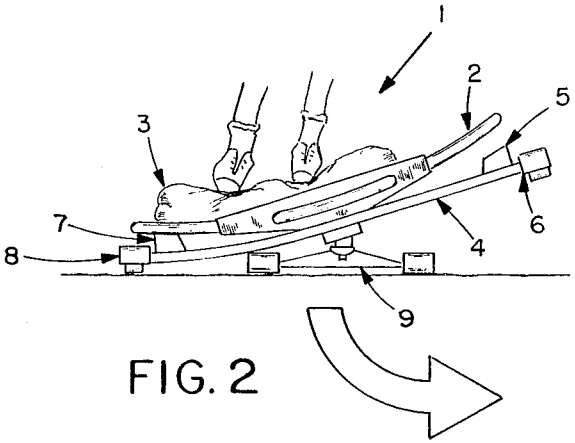
FIG. 2 is a front elevation view showing lateral motion of a riding pad and flexing of a laterally extending flexible wheel structure of the apparatus of FIG. 1 in a left turn.
Figure 3:
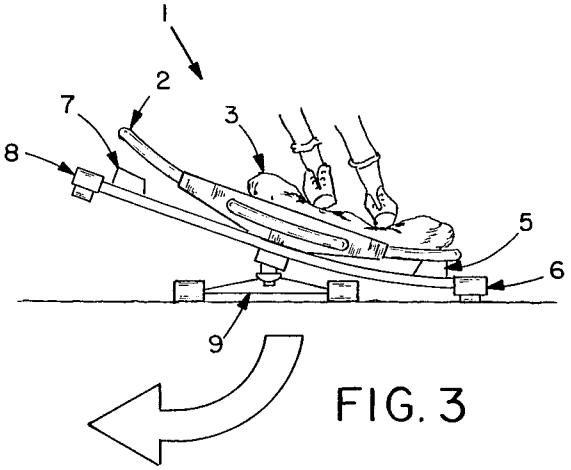
FIG. 3 is a front elevation view showing lateral motion of the riding pad and flexing of the laterally extending flexible wheel structure of the apparatus of FIG. 1 in a right turn.

Referring to FIGS. 1, 2 and 3, there is provided in accordance with the present invention a roller board apparatus designated generally as 1. In the apparatus 1 there is provided a platform comprising a curved frame structure 2. Structure 2 is curved up toward the lateral edges, as will be further described below. Mounted to the top of the structure 2 there is provided a riding pad and sheet assembly 3. Mounted to the underside of the frame structure 2 and extending laterally from the center thereof there is provided an elongated flexible wheel supporting structure 4. Attached to the left end of the structure 4 there is provided a block 5 and a wheel assembly 6. Attached to the right end of the member 4 there is provided a block 7 and a wheel assembly 8. Mounted along the centerline of the structure 2 at the forward and rear ends thereof there is provided a pair of skate-type wheel units 9 and 10. Only the front wheel unit 9 is shown in FIG. 1.

Figure 4:
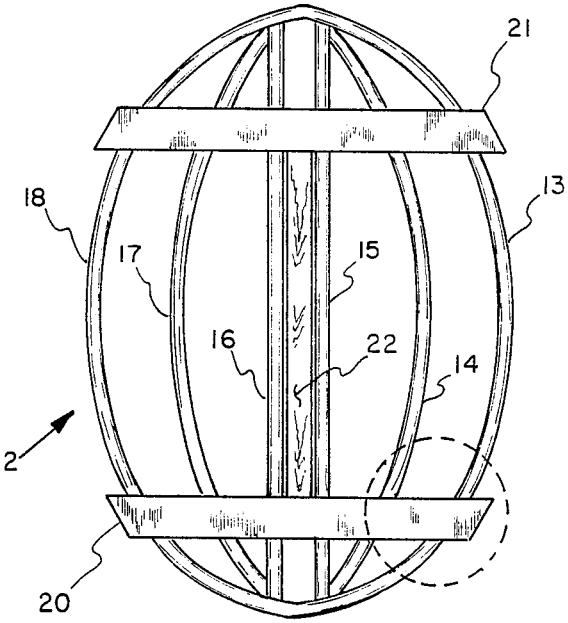
FIG. 4 is a top plan view of the curved platform of the present invention.
Figure 5:
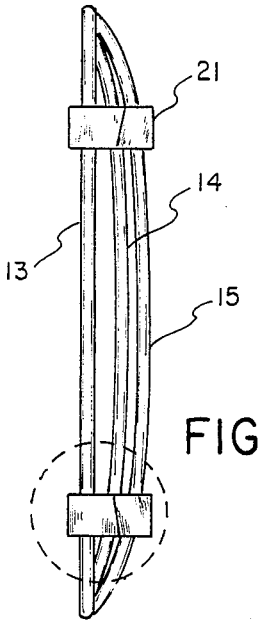
FIG. 5 is a side elevation view of FIG. 4.
Figure 6:
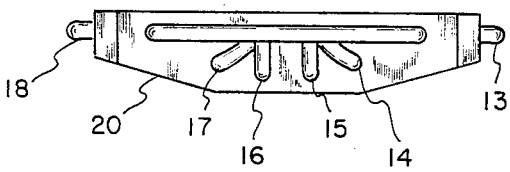
FIG. 6 is a front elevation view of FIG. 4.

Referring to FIG. 4, there is provided in the structure 2 a plurality of elongated curved tubular members 13, 14, 15, 16, 17 and 18, a pair of elongated generally rectangular bracing structures 20 and 21 and a center beam 22. In practice, the members 13–18 comprise curved lengths of 480 psi polyvinylchloride (PVC) tubing having an outside diameter of one inch. The beam 22 typically comprises a length of oak wood having a generally rectangular cross-section. The beam 22 extends between the structures 20 and 21. The tubular members 13–18 are joined at their respective ends as by gluing or cement. The width of the structure 2 is typically 24 inches and the length is typically 36 inches.

Figure 4A:
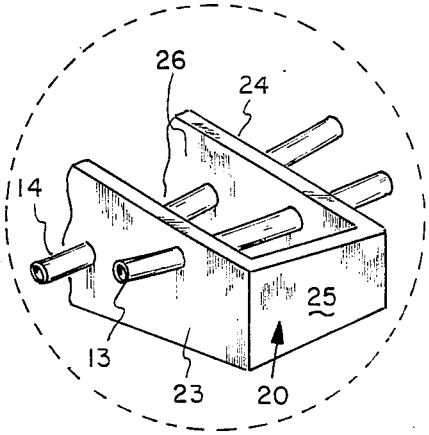
FIG. 4A is a magnified perspective of a bracing member construction according to the present invention.
Figure 7:
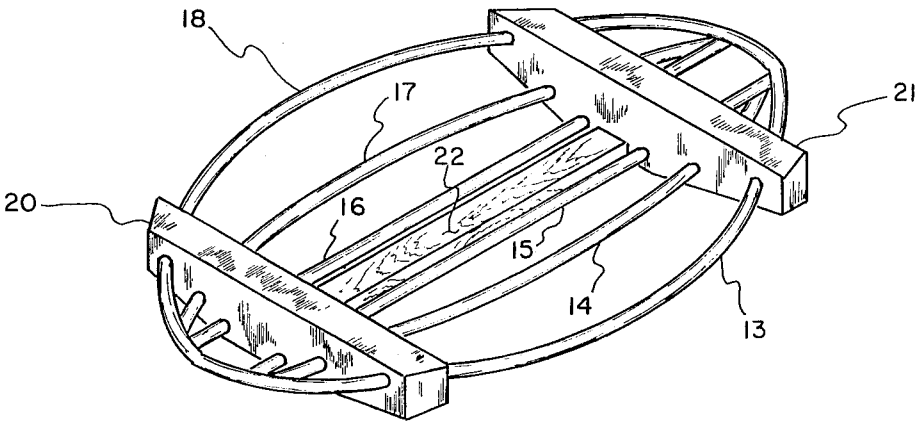
FIG. 7 is a perspective view of the platform of FIG. 4.

Referring to FIG. 4A, there is shown in perspective an end view of the structure 20. In the structure 20 there is provided a pair of spaced wall members 23 and 24 which are joined by an end wall member 25. The structure 21 is constructed substantially in the same manner and attached to the opposite end of the beam 22. The tubular members 13–18 are passed through holes provided therefor in the structures 20 and 21. After the tubular members 13–18 are in place, the space 26 between the members 23 and 24 is filled with a plastic cement to solidify the members 13–18 to the bracing structures 20–21.

Figure 8:
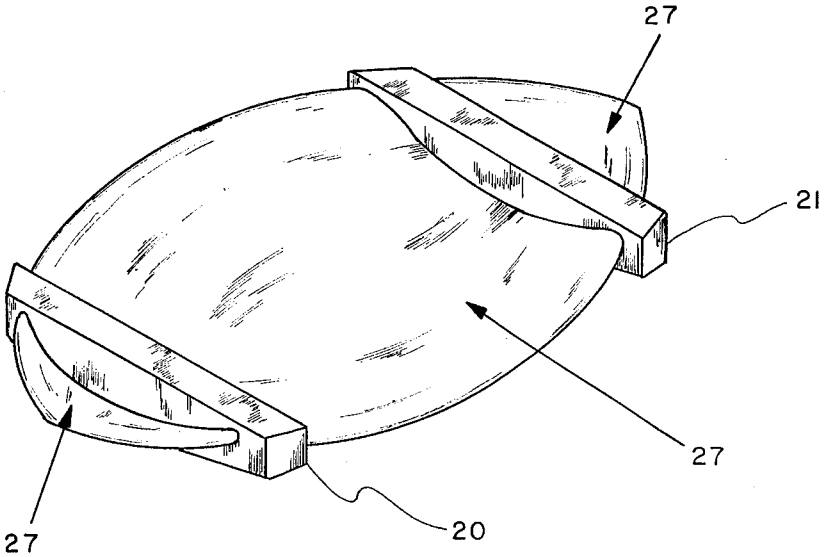
FIG. 8 is a perspective view of the platform of FIG. 4 after it is filled with a rigid foam and covered with Fiberglas sheeting.
Figure 14:
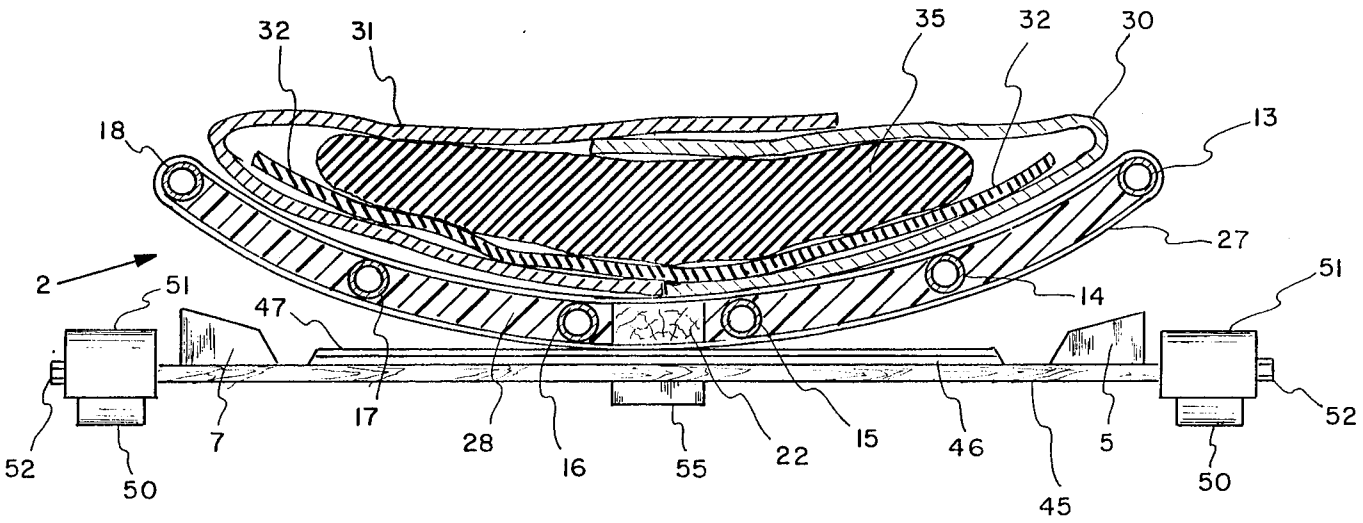
FIG. 14 is a cross-sectional view taken in the direction of lines 14—14 of FIG. 13.

After the structure 2 is assembled as shown in FIGS. 4–7, the tubular members 13–18 are encased within an envelope of foam material 28 which, when cured, forms a rigid structure having upper and lower curved surfaces conforming generally to the shape of the members 13–18 as shown in FIG. 14. After the members 13–18 are enclosed within an envelope of foam 28, the foam 28 and the members 13–18 are further enclosed within a sheet of Fiberglas material or the like, as shown in FIG. 8. When the structure 2 is enclosed within the sheet of Fiberglas material 27, the structure 2 comprises a curved rigid structure which has a shape corresponding to a section of watermelon rind of comparable size.

Figure 9:
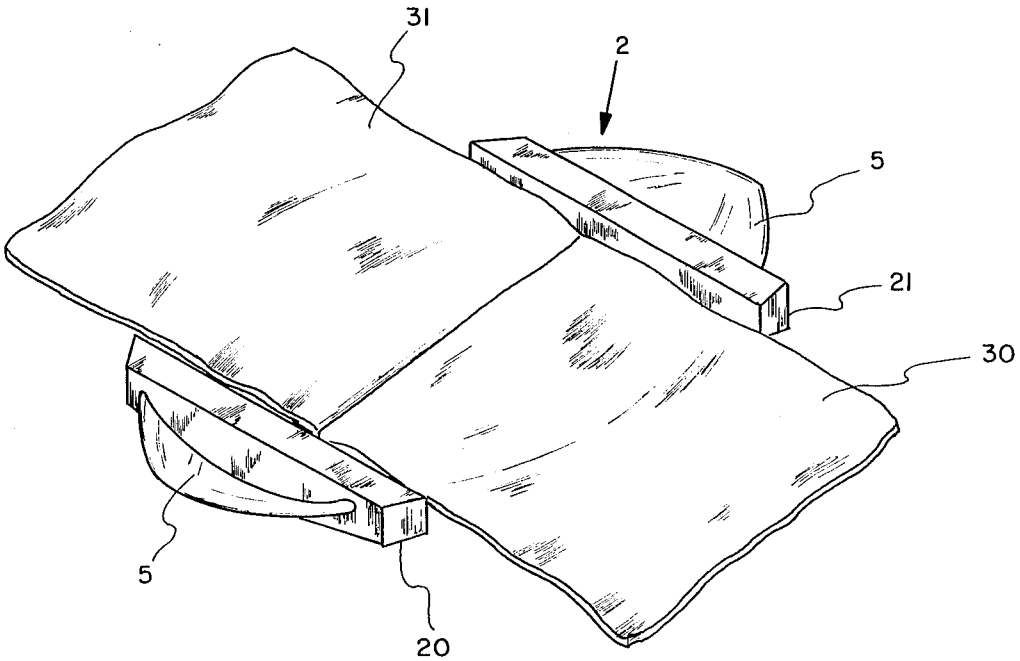
FIG. 9 is a perspective view of the apparatus of FIG. 8 with a pair of sheets attached to the top surface thereof.

Referring to FIG. 9, there are provided two sheets 30 and 31, each of which comprises a sheet of ⅛-in. closed-cell foam material covered with Nylon sheeting. The interior margins of the sheets 30 and 31 are attached to the upper surface of the structure 2 at the center thereof as shown in FIGS. 9 and 14.

Figure 10:
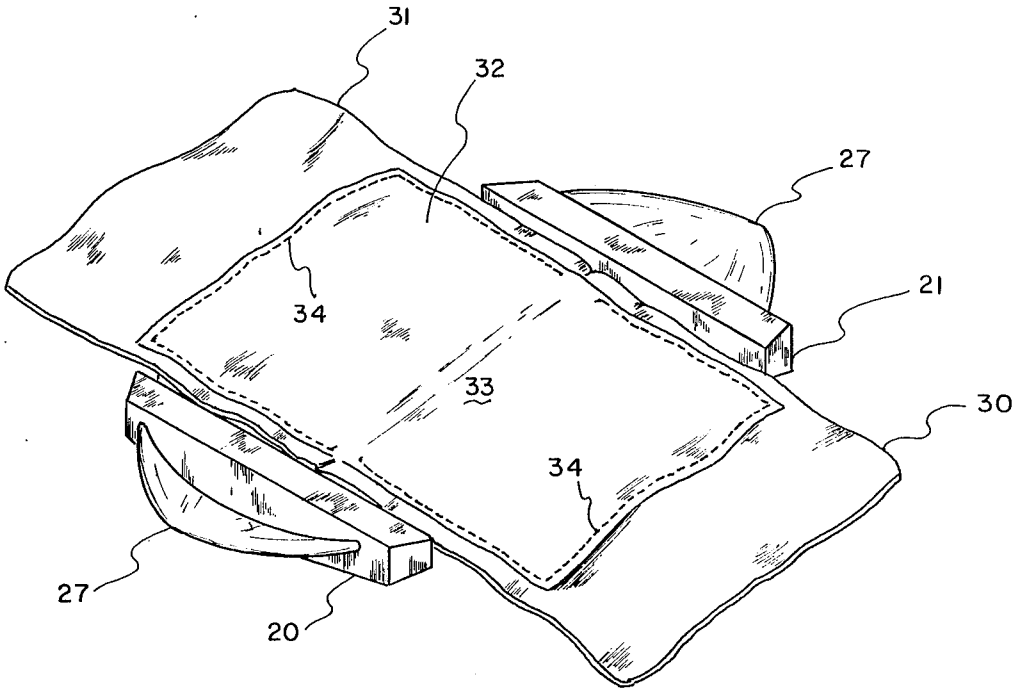
FIG. 10 is a perspective view of the apparatus of FIG. 9 with a low friction sheet attached to the underlying sheeting thereof.

Referring to FIG. 10, there is provided on top of the inner halves of the sheets 30 and 31 a sheet 32. Sheet 32 comprises a low friction surface 33 such as a surface of polytetrafluoroethylene. This material is often sold under the brand name of TEFLON. The sheet 32 is attached to the sheets 30 and 31 along its periphery as by sewing as shown by the broken lines 34.

Figure 11:
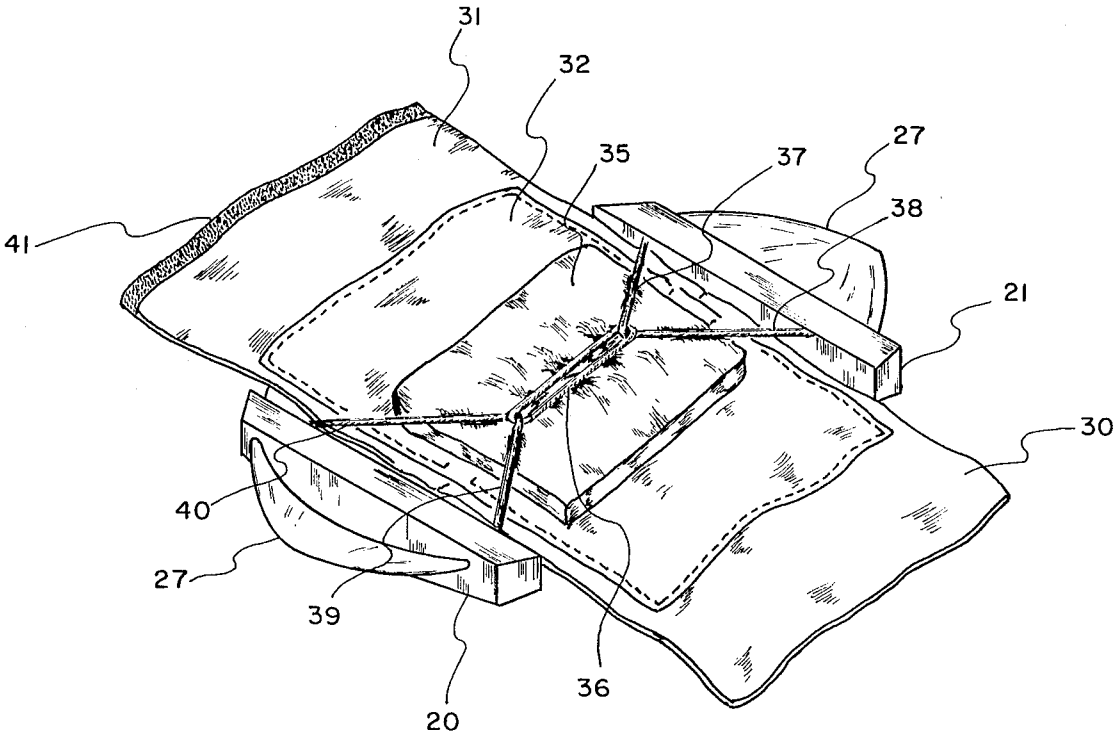
FIG. 11 is a perspective drawing of the apparatus of FIG. 10 with a riding pad and elastic retention mechanism mounted on the low friction sheeting thereof.

Referring to FIG. 11, after the sheet 32 is sewn to the sheets 30 and 31, a riding pad 35 comprising a fiber-filled Dacron polyester pillow is placed in the center thereof. Overlying a central portion of the pad 35 there is provided a center strut 36. Extending outwardly from opposite ends of the strut 36 there are provided four elastic members 37, 38, 39 and 40. The opposite ends of the members 37 and 38 are attached at spaced points to the bracing structure 21. Similarly, the opposite ends of the elastic members 39 and 40 are attached at spaced points to the bracing structure 20. Together, the strut 36 and members 37–40 resiliently secure the pad 35 in the center of the sheet 32.

Figure 12:
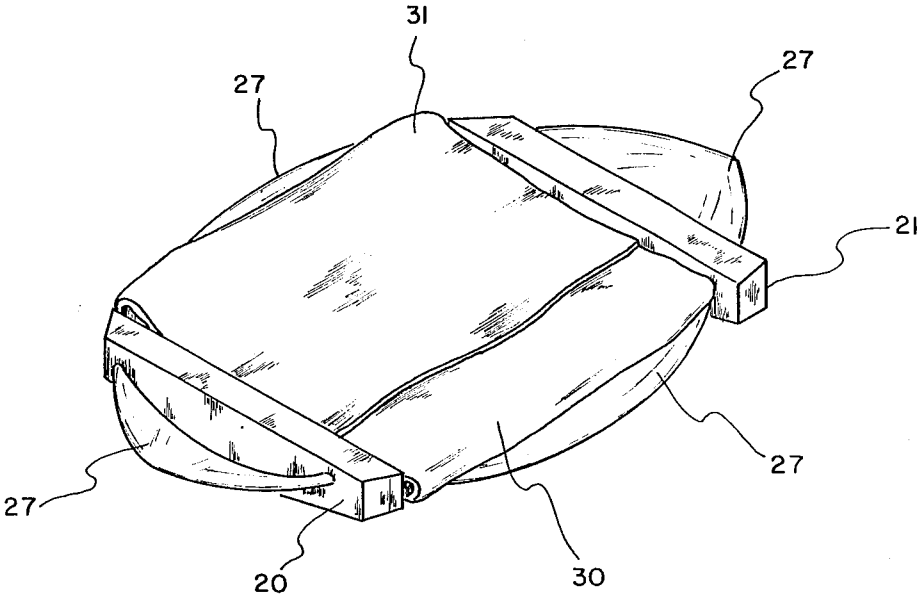
FIG. 12 is a perspective view of the apparatus of FIG. 11 with surface sheeting wrapping the riding pad thereon.

Referring to FIG. 12, after the strut 36 and members 37–40 are provided over the pad 35, the free ends of the sheets 30 and 31 are folded over the pad 35. The free end of the sheet 31 is then releasably attached to the sheet 30 in any suitable manner as, for example, by a strip 41 of material such as the hook and loop material sold under the brand name Velcro.

Figure 13:
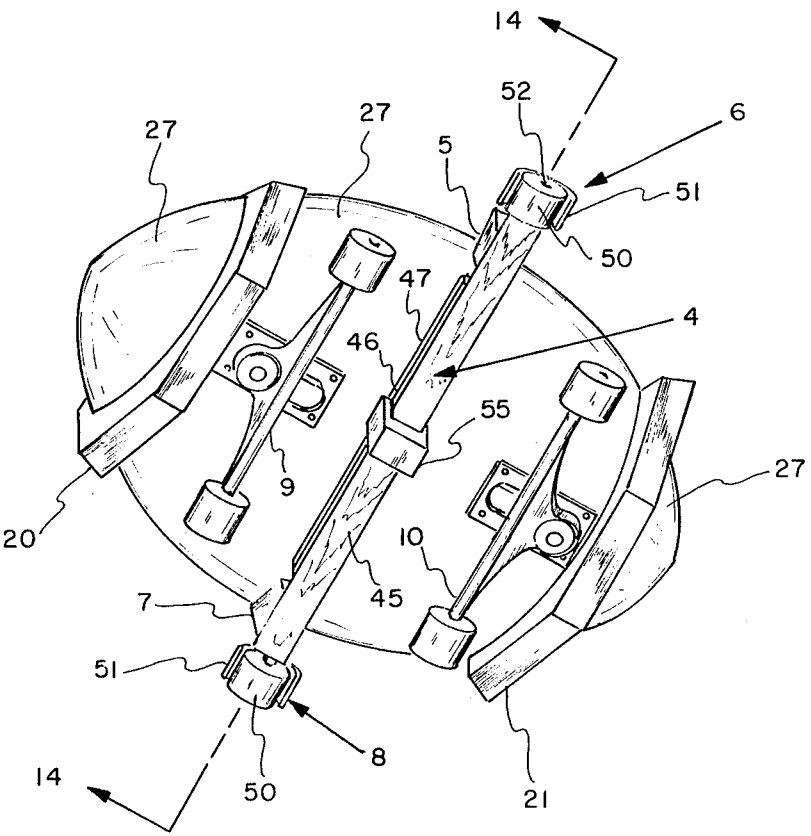
FIG. 13 is a perspective view of the bottom of the platform showing a laterally extending flexible wheel structure and the orientation of skate-type wheel units attached thereto.
Figure 15:
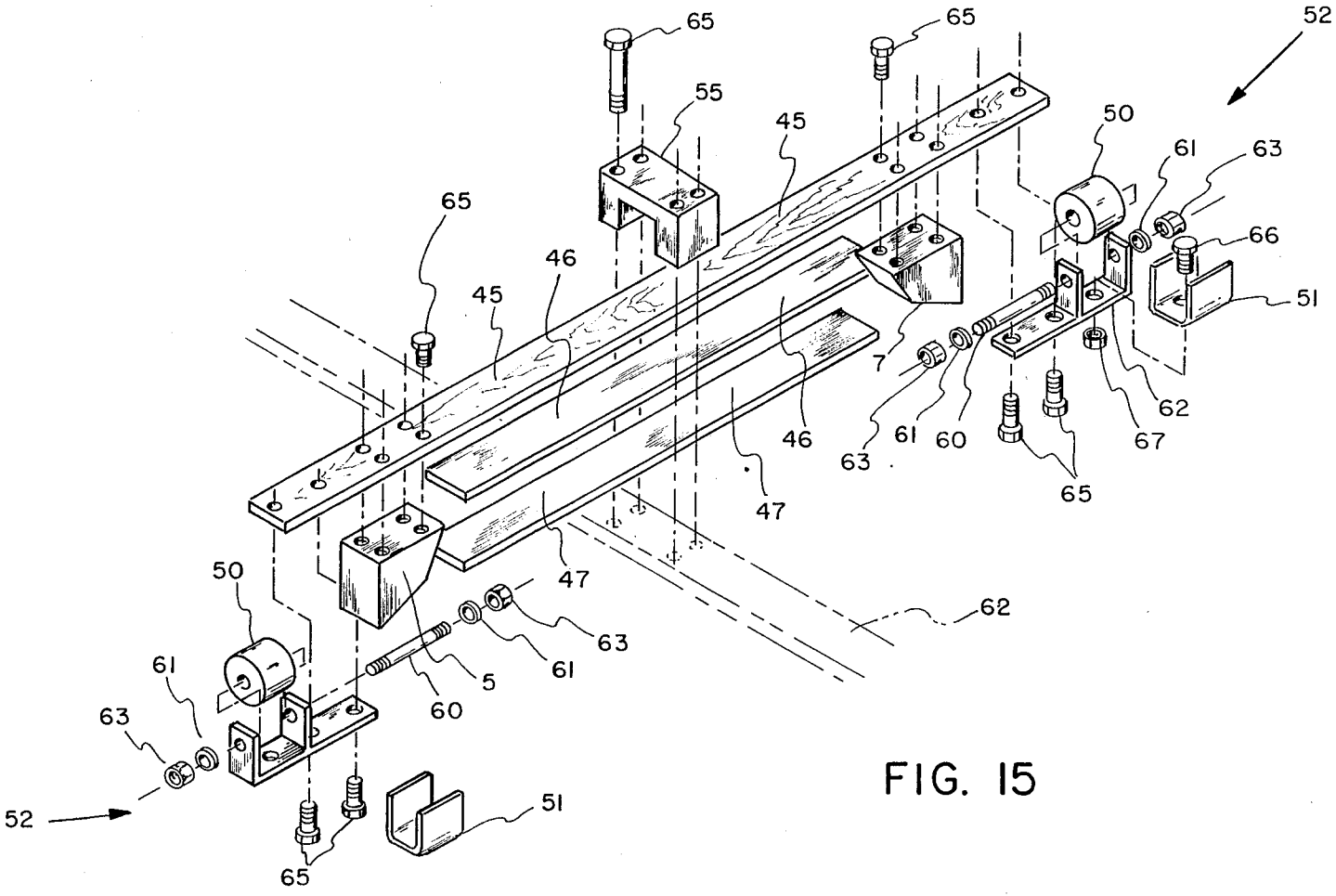
FIG. 15 is an assembly perspective drawing of the flexible wheel structure.

Referring to FIGS. 13–15, there is provided in the flexible structure 4 an elongated generally rectangular ¼-in. fiber reinforced plywood member 45. On top of the member 45 there is provided an elongated rectangular strip 46 of 5 psi closed-cell rubber foam. On top of the strip 46 there is provided a second elongated generally rectangular ¼-in. plywood member which is in contact with the lower surface of the structure 2. The members 45 and 47 and the strip 46 form the flexible member 4. Mounted to the top of the member 45 at opposite ends of the strip 46 and member 47 there is provided the blocks 5 and 7. Mounted to the ends of the member 45 there is provided the wheel assemblies 6 and 8.

In each of the wheel assemblies 6 and 8 there is provided a wheel member 50, a wheel fender 51 and a nut and axle assembly 52. The assembly 52 is provided in each of the wheel assemblies 6 and 8 for attaching the wheels to the ends of the member 45 and for adjusting braking resistance or, in other words, the amount of torque required to turn the wheel members 50.

As seen in the center of FIGS. 13 and 15, the flexible structure member 4 is attached to the center of the beam 22 by means of a ¼-in. fiber reinforced plywood member 55.

Referring to FIG. 15, there is provided in each of the assemblies 52 a wheel axle 60, a pair of Teflon-type washers 61 for assuring smooth braking resistance, a U-shaped metal wheel brace 62 for holding the axle 60 on the member 4 and a pair of nuts 63 for holding the axle 60 within the brace 62 and for tightening the brace against the wheel 50 to adjust the magnitude of the torque required to turn the wheel 50. The brace 62 and the member 55 are attached as by screws 65.

Figure 16:
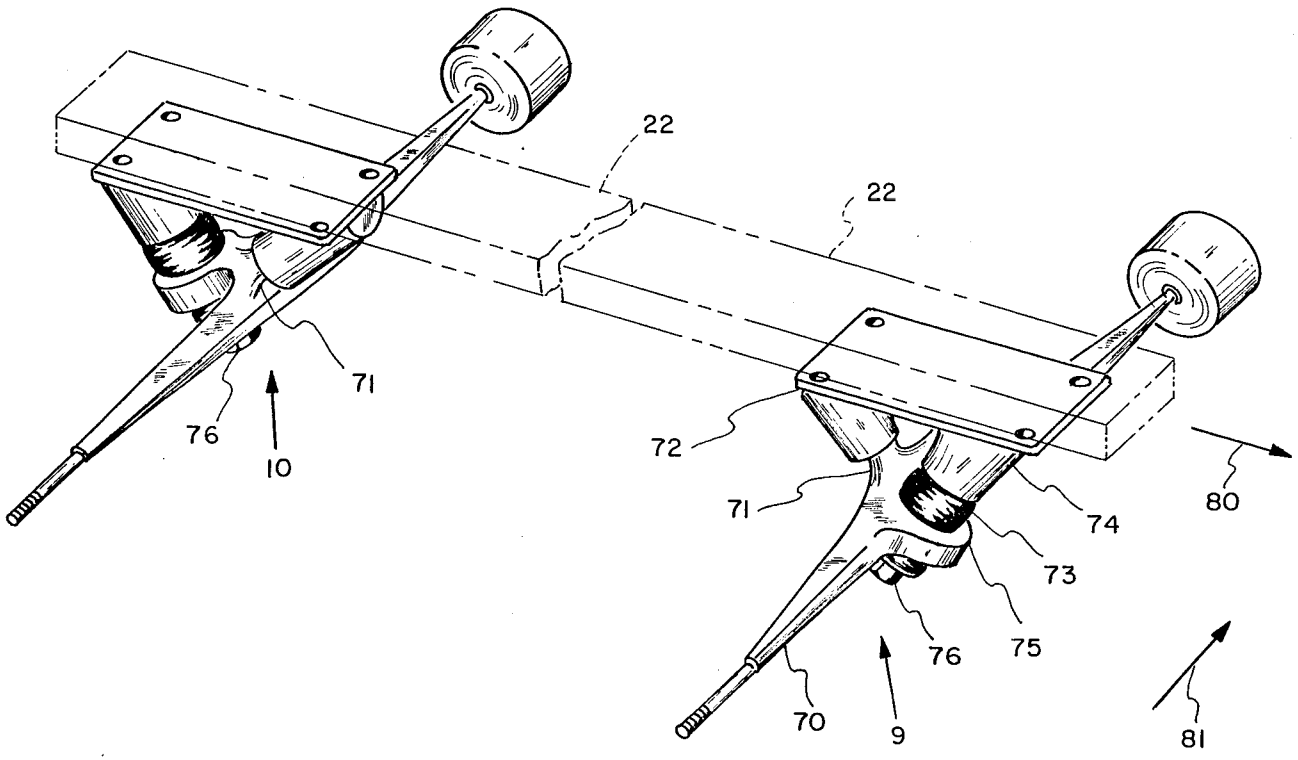
FIG. 16 is a perspective view of skate-type wheel units in the orientation to be utilized in the present invention.

Referring to FIG. 16, the wheel units 9 and 10 are commercially available wide track skateboard-type wheel units having a 7-inch axle. In each of the units 9 and 10 there is provided a 7-inch axle 70. The axle 70 is connected to the beam 22 by a pivot arm 71 pivotally connected to a plate 72. The arm 71 extends from the axle 70 at an angle toward the center of the apparatus 1. Extending from the axle 70 at an angle toward the end of the apparatus 1, there is provided a rubber bushing 73. The bushing 73 extends into a metal socket 74 attached to the plate 72 and a U-shaped flange 75 which extends from the axle 70. Below the flange 75 is a nut 76. The nut 76 is threaded onto a stud which extends through the center of the bushing 73.

In operation, if the apparatus 1 is moving in the direction of the arrow 80 and a rider's weight is shifted to the right of the arrow 80, the nut 76 on both of the units 9 and 10 will be moved to the left of the arrow 80 in the direction of the arrow 81. This will cause the unit 9 to pivot in a counterclockwise direction about its arm 71 and the unit 10 to pivot in a clockwise direction about its arm 71 causing the apparatus 1 to execute a left turn. If a rider's weight is shifted to the opposite side, the apparatus 1 will turn to the right. The rubber bushings 73, which act like a spring resisting the above-described weight shifts, return the wheel units 9 and 10 to their neutral position when the rider's weight is located over the center of the beam 22.

Referring again to FIGS. 1, 2 and 3, in operation, a rider desiring to travel in a straight line will stand in the middle of the apparatus 1 as shown in FIG. 1. When desiring to turn left, the rider will shift his or her weight to the right as shown in FIG. 2. Conversely, when desiring to turn right, the rider will shift his or her weight to the left as shown in FIG. 3. Stability is maintained during turns by the exterior wheel assemblies 6 and 8 and additionally, forward motion resistance is provided through friction which may be adjusted by means of the nut 63 in the wheel assemblies 6 and 8, thus allowing the rider to control speed on flat as well as inclined surfaces by turning. The blocks 5 and 7 and the flexure of the structure 4 resist the magnitude of the tilt during the right and left turns.

While an embodiment of the present invention is described above, it is contemplated that various modifications may be made thereto without departing from the spirit and scope thereof. Accordingly, it is intended that the embodiment described be considered only as illustrative of the present invention and that the scope thereof should not be limited thereto but be determined by reference to the claims hereinafter provided.

What is claimed is:

1. A movable roller board apparatus comprising:

a first structure;

a second structure having a front end and a rear end;

means for movably mounting said first structure on said second structure so that said first structure is free to be moved in a horizontal direction to the left or right relative to said second structure so as to facilitate off-center loading of said second structure by a person standing on said first structure facing frontward;

means for resiliently biasing said first structure to a central position relative to said second structure; and a set of wheels located at each end of said second structure for movably supporting said second structure, each of said sets of wheels being attached to said second structure by steering means such that each of said sets of wheels rotates about an axis in response to an off-center loading of said second structure such that said apparatus turns to the right when said off-center loading is to the left and said apparatus turns to the left when said off-center loading is to the right.

2. A roller board apparatus comprising:

a laterally curved platform means;

a plurality of steering mechanisms for turning said apparatus along selected arcs of curvature;

a foot supporting means movably supported by said laterally curved platform means for lateral movement relative thereto with a lateral degree of freedom adjustable and independent of said arcs of curvature of said steering mechanisms;

a plurality of supporting wheels movably secured in each of said steering mechanisms to each end of said laterally curved platform means along the longitudinal axis adjacent the opposite end portions thereof, said supporting wheels including a plurality of skate-type roller wheels having limited steering capabilities in response to a shift of a rider's weight crosswise of said laterally curved platform means; and laterally extended members centered and perpendicular to the board longitudinal axis with wheels attached at extreme outward ends to support said laterally curved platform means during lateral motion of said foot supporting means, said extended members including means for providing resistance to tilting of said laterally curved platform means about said longitudinal axis; and means for providing frictional resistance to rotation of said wheels attached to said ends of said extended members for controlling speed in a turn.

3. The roller board apparatus as defined in claim 2 wherein said foot supporting means is spring-biased to the center of said laterally curved platform means.

4. The roller board apparatus of claim 2 wherein said laterally curved platform means is shaped to maintain parallel foot position relative to ground when in a tilted position with rider's feet in a laterally shifted position relative to a centerline of said laterally curved platform means.

5. The roller board apparatus as defined in claim 2 wherein said laterally curved platform means comprises a low friction laterally curved surface upon which said foot supporting means slides.

6. The roller board apparatus as defined in claim 2 wherein said skate-type roller wheels are opposed such that off-center weight on the laterally curved platform means to the right results in said skate-type roller wheels steering to the left and off-center weight on said curved platform means to the left results in skate-type roller wheels steering to the right.

* * * * *

UNITED STATES PATENT AND TRADEMARK OFFICE

CERTIFICATE OF CORRECTION

PATENT NO. : 4,744,576

DATED : May 17, 1988

INVENTOR(S) : Hugh J. Scollan, Jr.

It is certified that error appears in the above-identified patent and that said Letters Patent is hereby corrected as shown below: On the title page In the Abstract, lines 1 & 2, "payment" should be --pavement--.
line 3, "support" should be --supported--.

Signed and Sealed this

Eleventh Day of October, 1988

*Attest:*

DONALD J. QUIGG

*Attesting Officer*

*Commissioner of Patents and Trademarks*